US006928664B2

(12) United States Patent
Price

(10) Patent No.: US 6,928,664 B2
(45) Date of Patent: Aug. 16, 2005

(54) MICROBIOSTATIC GARMENT

(76) Inventor: Gary L. Price, Price Enterprises, 3446 Charles City Rd., Richmond, VA (US) 23231

( * ) Notice: Subject to any disclaimer, the term of this patent is extended or adjusted under 35 U.S.C. 154(b) by 62 days.

(21) Appl. No.: 10/278,905

(22) Filed: Oct. 24, 2002

(65) Prior Publication Data

US 2004/0078863 A1 Apr. 29, 2004

(51) Int. Cl.[7] ..... A41D 13/00; A61L 2/232

(52) U.S. Cl. ..... 2/455; 2/901; 424/443; 604/360

(58) Field of Search ..... 2/455, 456, 457, 2/901; 424/443; 442/123, 394, 398; 604/360, 367

(56) References Cited

U.S. PATENT DOCUMENTS

| | | | | |
|---|---|---|---|---|
| 4,272,851 A | | 6/1981 | Goldstein | |
| 4,411,928 A | | 10/1983 | Baldwin | |
| 4,683,593 A | | 8/1987 | Langley | |
| 4,919,998 A | | 4/1990 | Goad et al. | |
| 4,932,078 A | | 6/1990 | Jones et al. | |
| 5,027,438 A | | 7/1991 | Schwarze et al. | |
| 5,035,892 A | * | 7/1991 | Blank et al. | 424/443 |
| 5,416,929 A | | 5/1995 | Braunstein | |
| 6,040,251 A | | 3/2000 | Caldwell | |
| 6,041,446 A | | 3/2000 | Braunstein | |
| 6,528,472 B2 | * | 3/2003 | Charaf et al. | 510/391 |
| 6,677,258 B2 | * | 1/2004 | Carroll et al. | 442/394 |

FOREIGN PATENT DOCUMENTS

JP 8-175905 7/1996

OTHER PUBLICATIONS

"Klean Shield Microbiostatic Coating", Product Information, Kor–Chem Inc., Atlanta, Georgia. Date unknown.

* cited by examiner

*Primary Examiner*—Peter Nerbun
(74) *Attorney, Agent, or Firm*—Richard C. Litman

(57) ABSTRACT

The microbiostatic garment is a disposable, protective garment to be worn for inhibiting microbial growth on persons exposed to a microbial environment. The microbiostatic garment is manufactured from a nonwoven, spunbonded olefin, or a polypropylene nonwoven fabric. The garment is coated with an aqueous organosilane.

6 Claims, 1 Drawing Sheet

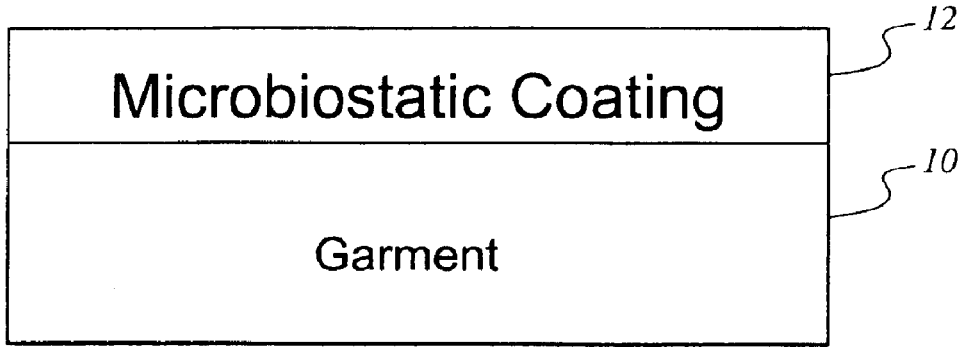
Microbiostatic Coating
Garment
12
10

MICROBIOSTATIC GARMENT

BACKGROUND OF THE INVENTION

1. Field of the Invention

The present invention relates to disposable garments, and particularly to disposable garments with microbiostatic properties.

2. Description of the Related Art

Hazardous environment garments are worn for protection in contaminated areas. Such garments are frequently disposable, that is, designed for single or limited use in view of the fact that the suits themselves may become contaminated by contact with the hazardous environment. Disposable fabrics are typically nonwoven, and made from lightweight synthetic fibers, or synthetic fibers blended with natural fibers.

Disposable garments are frequently worn in chemically hazardous environments for a variety of reasons. Performance of disposable non-woven fabrics in terms of liquid repellancy and flame retardancy are quite acceptable. Reusable fabrics, on the other hand, are woven and may be constructed from cotton or cotton/polyester blends of a high thread count and tend to lack the liquid repellancy associated with disposables, especially after repeated laundering. Disposable garments are also preferred because they require lower cost material when compared with material which would otherwise be necessary to permit a reusable garment to survive repeated cleaning and decontamination.

Garments which are manufactured for wear in environments with biological hazards or microbial presence are subject to similar considerations of durability, liquid repellancy, and cost. Consequently, it is also desirable to provide a disposable garment which is resistant to biological hazards, and which is tear resistant.

U.S. Pat. No. 6,040,251, issued Mar. 21, 2000 to J. Caldwell, discloses novel barrier webs that have an at least partially cured polymer composition derived from a shear-thinable thixotropic polymer, and possess water resistance, increased durability, and improved barrier qualities. One embodiment of the invention discloses a fabric being adapted to be substantially impermeable to liquids, permeable to gases, and impermeable to microorganisms.

U.S. Pat. No. 4,411,928, issued Oct. 25, 1983 to A. Baldwin, discloses a process for making a non-woven fabric which is predominantly cellulosic in nature (paper, cotton, rayon, and possibly wool) and that can destroy migrating and cross-contaminating bacteria, fungi, and algae. The process comprises immersing a non-woven substrate in a pad bath containing a C1–C4 alcohol, a silicone quaternary amine bioactive material, a cationic wax, a water repellant, a monovalent salt, and water.

Other patents relating to protective garments include, U.S. Pat. No. 5,416,929, issued May 23, 1995 to R. Braunstein (a panty having antimicrobial treated crotch for killing and inhibiting the growth of yeast and bacteria); U.S. Pat. No. 6,041,446, issued Mar. 28, 2000 to R. Braunstein (panty with integrated crotch); U.S. Pat. No. 5,027,438, issued Jul. 2, 1991 to C. Schwarze et al. (operating room clothing with coated fabric); U.S. Pat. No. 4,272,851, issued Jun. 16, 1981 to L. Goldstein (hazardous environment suit); U.S. Pat. No. 4,683,593, issued Aug. 4, 1987 to J. Langley (protective garment in which an inner layer is spun bonded olefin and an outer layer is of a bondable film); U.S. Pat. No. 4,919,998, issued Apr. 24, 1990 to C. Goad (woven medical fabric); U.S. Pat. No. 4,932,078, issued Jun. 12, 1990 to R. Jones (unitized garment system for particulate control); and Japanese Patent No. 8-175905 (anti-microbial deodorant).

In a preferred embodiment of the present invention, a microbiostatic coating made by Kor-Chem, Inc. of Atlanta, Ga. and marketed under the trade name KLEAN SHIELD is applied to a garment made from nonwoven, thermoplastic material. A Product Information sheet supplied by the manufacturer (undated) indicates that KLEAN SHIELD may be applied to fabrics, including fabrics made from polyethylene, polyolefins, polypropylene, etc. However, the Product Information sheet does not suggest its application to garments. Particular uses suggested are for carpets, draperies, mattress pads, tents, sails, etc.

None of the above inventions and patents, taken either singly or in combination, is seen to describe the instant invention as claimed. Thus, a microbiostatic garment solving the aforementioned problems is desired.

SUMMARY OF THE INVENTION

The microbiostatic garment is a disposable, protective garment to be worn to inhibit microbial growth on persons exposed to a microbial environment. The microbiostatic garment is manufactured from a non-woven, spunbonded olefin, or a nonwoven polypropylene fabric. The garment is coated with an aqueous organosilane.

Accordingly, it is a principal object of the invention to provide a microbiostatic garment.

It is another object of the invention to provide a microbiostatic garment which is disposable.

It is a further object of the invention to provide a microbiostatic garment which is made from nonwoven fabric.

Still another object of the invention is to provide a microbiostatic garment which is nontoxic.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

The FIGURE is a schematic representation of a coating on a garment.

DETAILED DESCRIPTION OF THE PREFERRED EMBODIMENT

The present invention is a microbiostatic, disposable garment. The garment can be any garment or item of clothing, including but not limited to, caps, hoods, boot or shoe covers, protective suits, laboratory coats or trousers, surgery gowns, and personal garments. The garment can be worn for protection against microbial hazards in laboratories, hospitals, or other settings in which one may be exposed to microbial life, such as bacteria, fungi, mold, mildew, and algae. As seen in the FIGURE, the garment 10 has a microbiostatic coating 12 for inhibiting the growth of any bacteria, fungi, mold, mildew, and algae which may contact the surface of the garment.

The microbiostatic coating used in the present invention includes an aqueous organosilane sold by Kor-Chem, Inc. of Atlanta, Ga. under the trade name KLEAN SHIELD. The product is generally described as an aqueous organosilane having a chemical composition comprising 0.5% by weight octadecylaminodimethyltrimethoxysilyl propyl ammonium chloride, <3% by weight chloropropyltrimethoxysilane, and <1.3% by weight methanol. The product is applied to a disposable, nonwoven fabric. Preferably, the fabric is a nonwoven, spunbonded olefin or a polypropylene nonwoven fabric. An example of a nonwoven, spunbonded olefin would be fabric sold by E.I. duPont de Nemours Inc., under its trademark TYVEK. TYVEK is composed of approximately 98% high density polyethylence and 0–1.3% antistatic agent (for electrical static). The nonwoven polypropylene may be made by spunbonding, point bonding, meltblowing, or any other process for preparing nonwoven fabrics known in the plastics or fabric industries.

The microbiostatic coating may be applied to the nonwoven fabric by spraying the surface of the garment or dipping the garment in a bath containing the microbiostatic coating. If the coating is applied by spraying, a trigger pump sprayer or a pressure sprayer may be used to spray the entire surface area of the garment. The sprayer should be held 4–6 inches from the surface of the garment. If the coating is applied by dipping or soaking, the microbiostatic coating must be emptied into a washbasin or tub in an amount sufficient to allow the garment to be completely submerged in the coating. The garment should be immersed in the coating for three minutes. After applying the coating to the garment, the garment must be allowed to dry.

It is to be understood that the present invention is not limited to the embodiment described above, but encompasses any and all embodiments within the scope of the following claims.

I claim:

1. A microbiostatic garment comprising:

a) a disposable garment; and b) a microbiostatic coating comprising an aqueous organosilane applied to said garment, wherein the aqueous organosilane comprises:

0.5% octadecylaminodimethyltrimethoxysilylpropyl ammonium chloride;

<3.0% chloropropyltrimethoxysilane; and

<1.3% methanol.

2. The microbiostatic garment of claim 1, wherein said disposable garment is made from a nonwoven fabric.

3. The microbiostatic garment of claim 2, wherein said nonwoven fabric is nonwoven polypropylene.

4. The microbiostatic garment of claim 2, wherein said nonwoven fabric is a nonwoven spunbonded olefin.

5. The microbiostatic garment of claim 2, wherein said olefin comprises high density polyethylene.

6. A microbiostatic garment comprising:

a) a disposable garment, said garment being made from a nonwoven, synthetic, polymeric fabric of thermoplastic material; and b) a microbiostatic coating comprising an aqueous organosilane, said organosilane having a composition comprising 0.5% octadecylaminodimethyltrimethoxysilylpropyl ammonium chloride;

<3.0% chloropropyltrimethoxysilane; and

<1.3% methanol;

wherein said microbiostatic coating is applied to said garment.

* * * * *